US005347211A

United States Patent [19]

Jakubowski

[11] Patent Number: 5,347,211

[45] Date of Patent: Sep. 13, 1994

[54] SELECTABLE OUTPUT POWER CONVERTER

[75] Inventor: Peter J. Jakubowski, Huntington Beach, Calif.

[73] Assignee: Innova Electronics Corporation, Fountain Valley, Calif.

[21] Appl. No.: 30,670

[22] Filed: Mar. 11, 1993

[51] Int. Cl.[5] ..... G05F 1/575

[52] U.S. Cl. ..... 323/351; 323/281; 323/285; 323/349; 363/146

[58] Field of Search ..... 323/281, 318, 349, 351, 323/275, 276, 277, 285; 363/146

[56] References Cited

U.S. PATENT DOCUMENTS

| | | | |
|---|---|---|---|
| 4,321,525 | 3/1982 | Imazeki et al. | 323/281 |
| 4,598,243 | 7/1986 | Kawakami | 323/281 |
| 4,987,360 | 1/1991 | Thompson | 320/6 |
| 5,297,015 | 3/1994 | Miyazaki et al. | 363/146 |

OTHER PUBLICATIONS

Minwa Products–MW182, Mar. 10, 1993.

Super Selection of Power Adapters–Radio Shack Catalog, (Dec. 1992; Catalog p. 128 #472).

*Primary Examiner*—Jeffrey L. Sterrett

*Attorney, Agent, or Firm*—Stetina and Brunda

[57] ABSTRACT

A power converter for providing a selectable desired voltage has a converter circuit having an input port for receiving an input of a first voltage and an output port for providing an output of a second voltage. The converter circuit also has a keyway for receiving a key. The key, which is configured to be received by the keyway, contains an electrical component and has a body within which the electrical component is disposed. The output voltage of the converter is determined by the value of the component disposed within the body of the key such that the output voltage can be varied by replacing the key with another key having an electrical component of a different value.

21 Claims, 4 Drawing Sheets

SELECTABLE OUTPUT POWER CONVERTER

FIELD OF THE INVENTION

The present invention relates generally to power converters and more particularly to a power converter for use with laptop computers and the like having an output voltage which is selectable by inserting an electronic key corresponding to the desired voltage into a keyway disposed within the converter.

BACKGROUND OF THE INVENTION

Converters for converting the output voltages of AC or DC sources into a voltage having a particular desired value are well-known. For example, laptop computers and the like commonly use such a power converter which plugs into a common wall outlet and electrically connects to the laptop computer. A step-down transformer and rectifying circuit are typically disposed within a housing to which the power plug is attached to facilitate electrical interconnection with the wall outlet. A filtering circuit may also be disposed within the housing.

Also, adapters or power converters for facilitating the use of laptop computers and the like from 12 volt DC sources, i.e., in automobiles, boats, etc., are likewise well-known. Such power converters contain the necessary circuitry for converting the 12 volt DC source voltage to a voltage suitable for powering the electrical device.

Unfortunately, the fact that there are many such electronic devices operating at many different voltages makes it difficult to provide a small number of power converters capable of servicing them all. The great diversity of such electronic devices requires that a large number of different power converters be provided. Each device typically has its own unique power requirements. As such, a power converter specifically intended for use with a particular electronic device must typically be provided therewith.

Also, it is similarly necessary to purchase a compatible, i.e., having the correct output voltage, substitute power converter when a replacement is required. The proliferation by different output voltages provided by different power converters makes it extremely difficult to maintain a wide selection of such power converters for use as replacements.

In an attempt to alleviate the above-mentioned deficiencies, prior art devices have been constructed so as to provide selectable output voltages. Such prior art devices utilize a switch formed thereon for facilitating selection of the desired output voltage. However, the use of such a switch inherently makes it possible to select an incorrect output voltage. The selection of such an incorrect output voltage may potentially damage the device powered thereby. This is particularly true if the incorrectly selected output voltage is higher than that required by the device powered thereby. The incorrect output voltage may be inadvertently selected by the user prior to utilizing such prior art selectable output voltage power converters or, alternatively, may accidentally be changed, i.e., via mishandling, after use thereof has commenced.

The output power selection switches of such prior art power converters are oftentimes difficult to read and/or set. This is, in part, due to the miniaturization of such devices, which requires such switches and their associated indicia be formed as small as possible. Thus, it is not uncommon for a user to inadvertently select the power output setting adjacent the desired setting.

One example of such a prior art selectable power converter is the Model MW182 800 mA Regulated DC Adapter manufactured by Minwa of Taiwan. This device provides the ability to convert the power output from a car cigarette lighter, i.e., 12 volts DC, to any one of the following outputs: 1.5, 3, 4.5, 6, 7.5 9, or 12 volts DC.

Although such power converters have proven generally suitable for their intended purposes, they possess inherent deficiencies which detract from their overall effectiveness in the marketplace.

SUMMARY OF THE INVENTION

The present invention specifically addresses and alleviates the above-mentioned deficiencies associated with the prior art. More particularly, the present invention comprises a power converter for providing a selectable, desired voltage for a laptop computer or other such electrically powered device. The selectable output power converter has a converter circuit having an input port for receiving an input of a first voltage and an output port for providing an output of a second voltage.

The converter circuit also has a keyway for receiving a key. A plurality of keys are provided, each key being used to cause the converter circuit to output a different voltage. The key, which is configured to be received by the keyway, contains an electrical component and has a body within which the electrical component is disposed. The output voltage of the converter is determined by the value of the electrical component disposed within the body of the key such that the output voltage can be varied by replacing the key with another key having an electrical component of a different value.

The key is preferably configured such that it will be marred, marked, rendered inoperative, or otherwise made indicative of prior use, once removed from the selectable power converter of the present invention. This eliminates the potential for a user, either through inadvertence or intention, to utilize a key resulting an output from the converter which is incorrect, i.e., too high, for the device so powered, thus resulting in damage to the device.

By making the key indicative of such prior use, it would be difficult for the user to maintain that the correct key had been installed at the time the device so powered was damaged. Such marring, marking, rendering inoperative, or other indication of prior use would indicate that the correct key had, at one time, been removed from the selectable output power converter of the present invention, thus raising the question of whether the correct key was installed at the time the device was damaged.

The electrical component of the key is used in feedback circuitry to set the output voltage. The converter circuit preferably utilizes a selectable voltage pulse width modulator (PWM) regulator. Overvoltage protection is utilized to limit damage due to a defective integrated circuit chip or other electrical component of the converter circuit.

Such overvoltage protection may be implemented by providing transistors which short out the input voltage to ground, thus causing an internal, non-replaceable fuse to open, when a reference voltage of an operational amplifier exceeds a selected value. This would occur only as a result of a catastrophic failure of the converter circuitry, wherein it would be assumed that the converter circuitry can no longer function reliably and should be disabled.

Alternatively, the output voltage may simply be monitored such that if an overvoltage condition is indicated, then an internal fuse is blown. Such an overvoltage condition may be indicated by the sensing of a voltage, for example of approximately 0.5 volts greater than the desired output voltage. Optionally, overvoltage may be indicated by monitoring for deviations of a normally steady-state reference voltage, i.e., 1.25 volt DC. Deviations from the nominal value indicate an overvoltage condition.

Additionally, input overvoltage protection may be utilized to prevent damage due to excessive input voltage or long duration high voltage spikes. For example, if the DC input voltage exceeds approximately 18 volts, then a zener diode conducts to turn on transistors which short the input to ground. Shorting of the input to ground results in a fuse blowing and consequent discontinuance of the output of the converter circuitry.

If the overvoltage condition is merely due to a spike, the zener diode conducts to turn on transistors but not long enough to cause the fuse to blow. The output voltage falls quickly when the transistors turn on. However, a spike having a duration beyond a preset limit will cause the fuse to blow, thus resulting in discontinuance of the output of the converter circuitry. The input overvoltage protection preferably causes the converter circuit to clamp down voltage spikes up to 75 volts and having durations of 10 milliseconds.

A low battery warning circuit is preferably utilized to indicate to the user that the source battery voltage has fallen below a predetermined level. For example, low battery warning may be accomplished by utilizing an LED which glows steadily when the unit is energized and which blinks when the source voltage drops below approximately 11 volts.

A low battery voltage shut-off turns off the output voltage when the input voltage falls below a predetermined level, i.e., 10.5 volts. This prevents damage from excessively discharging sealed lead-acid batteries and the like. The indicator LED will stop blinking, to indicate a low battery condition, and remain off, thus indicating that the power converter has shut down.

The selectable output power converter of the present invention may optionally be configured to mechanically and electrically attach to a portable DC power source such as the 12-volt DC cordless rechargeable POWERPAK sold by Innova of Fountain Valley, Calif. By attaching the selectable output power converter of the present invention to such a portable power source, the user is provided with a portable regulated power supply which may be utilized to run laptop computers and the like.

The track of the selectable output power converter of the present invention is specifically configured to slidably engage a complimentary track formed upon the POWERPAK. Electrical contacts formed upon the track of the selectable power converter of the present invention and corresponding electrical contacts formed upon the track of the POWERPAK facilitate electrical interconnection thereof.

These, as well as other advantages of the present invention will be more apparent from the following description and drawings. It is understood that changes in the specific structure shown and described may be made within the scope of the claims without departing from the spirit of the invention.

DETAILED DESCRIPTION OF THE PREFERRED EMBODIMENT

The detailed description set forth below in connection with the appended drawings is intended as a description of the presently preferred embodiment of the invention, and is not intended to represent the only form in which the present invention may be constructed or utilized. The description sets forth the functions and sequence of steps for constructing and operating the invention in connection with the illustrated embodiment. It is to be understood, however, that the same or equivalent functions and sequences may be accomplished by different embodiments that are also intended to be encompassed within the spirit and scope of the invention.

Although described herein as a selectable output power converter having particular applicably for use in powering laptop computers and the like from a 12 volt DC power source, those skilled in the art will recognize that various different electrical devices may likewise be powered from various sources, i.e., AC or DC. Indeed, various outputs, i.e., AC or DC, are similarly contemplated.

Figure 1:
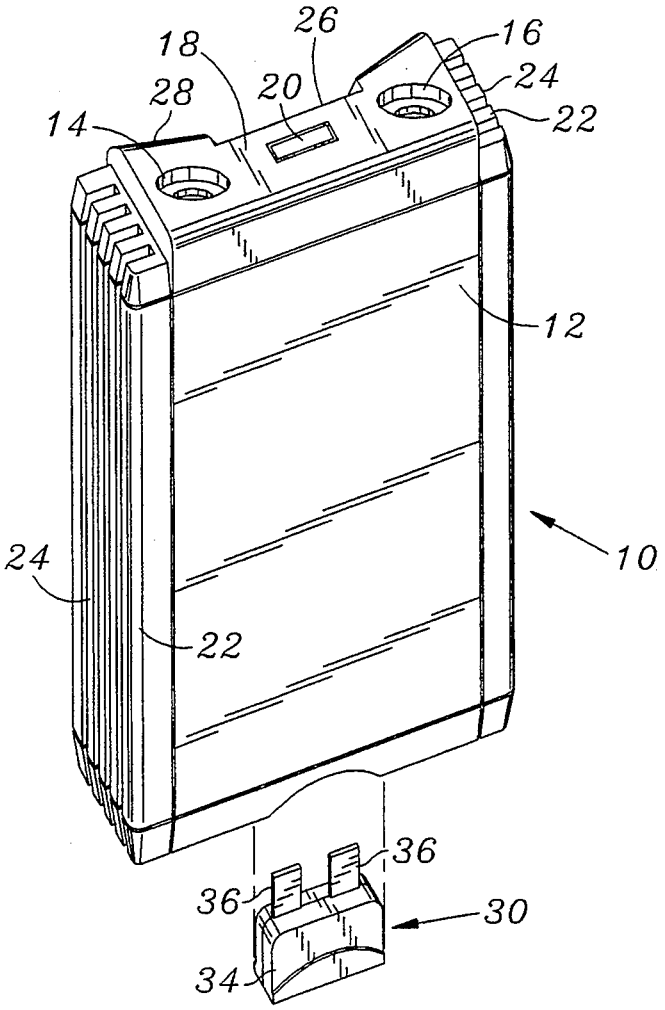
FIG. 1 is a perspective view of the power converter of the present invention illustrating insertion of the key into the keyway thereof.
Figure 3:
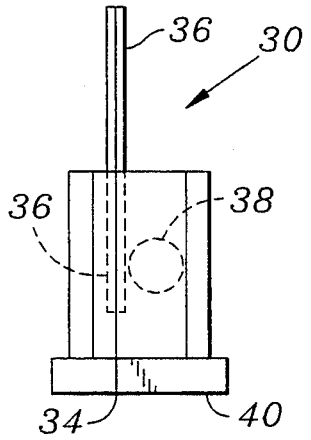
FIG. 3 is an enlarged side view of the key of FIGS. 1 and 2.
Figure 4:
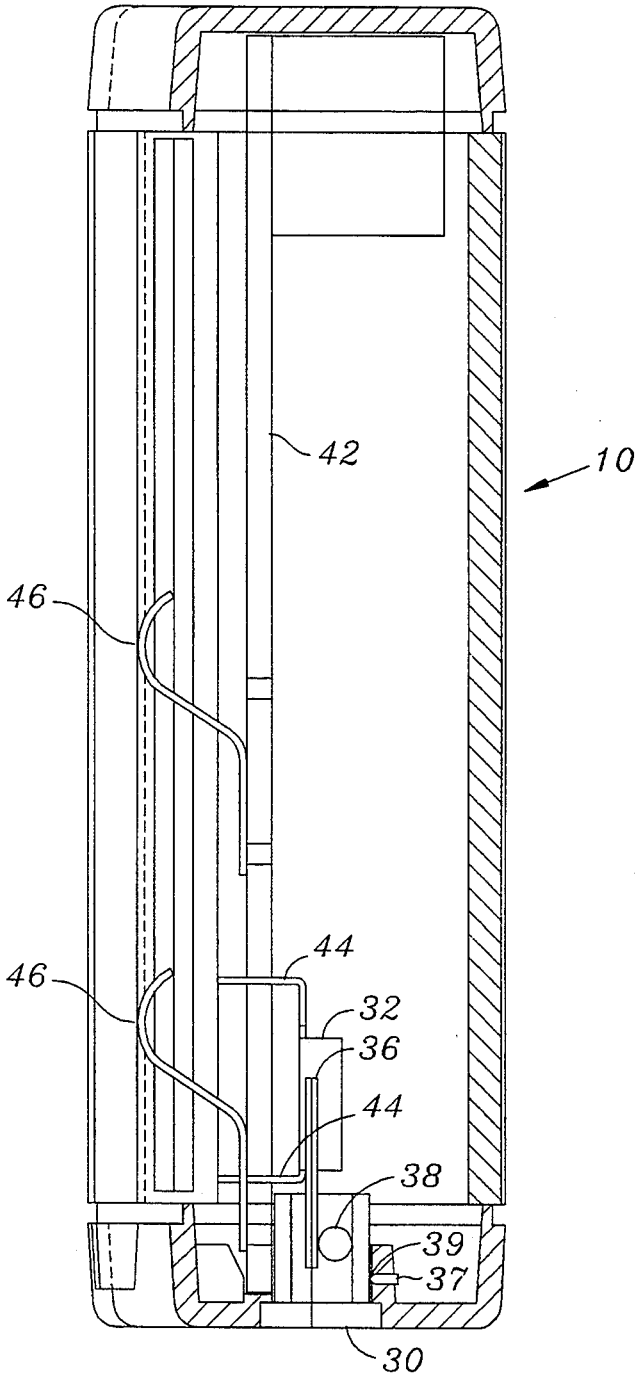
FIG. 4 is cross-sectional side view of the converter means of FIG. 1 showing the key inserted within the keyway thereof.
Figure 5:
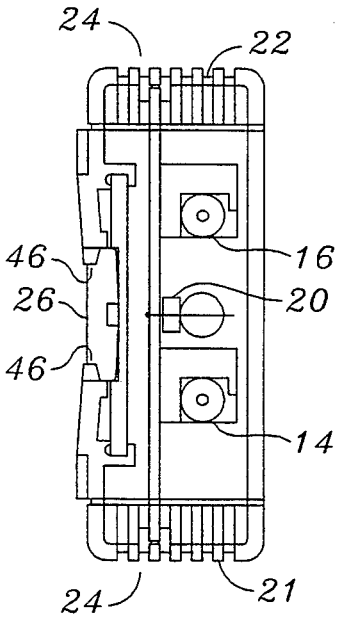
FIG. 5 is a top plan view of the converter means of FIGS. 1 and 4.
Figure 7:
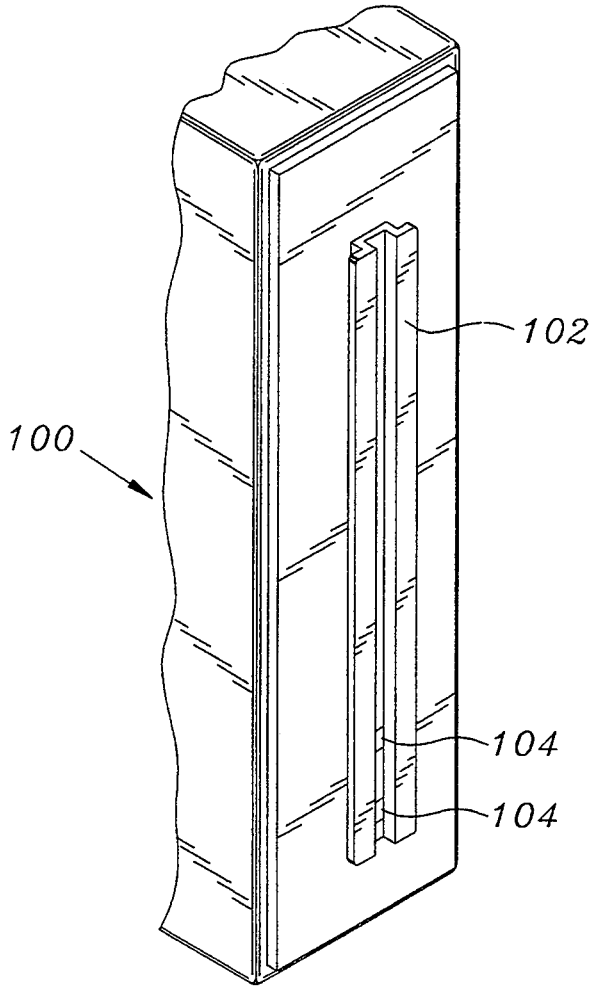
FIG. 7 is a fragmentary perspective view of a POWERPAK showing the track formed thereon for facilitating attachment to the present invention.
Figure 8:
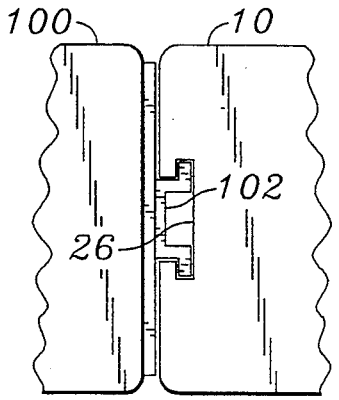
FIG. 8 is an enlarged top view showing engagement of the tracks of the POWERPAK with the tracks of the present invention.

The selectable output power converter of the present invention is illustrated in FIGS. 1 through 6 which depict a presently preferred embodiment of the invention. FIGS. 7 and 8 depict a POWERPAK portable DC power source to which the present invention may be attached. Referring now to FIGS. 1 and 5, the selectable output power converter of the present invention generally comprises a converter 10 having a housing 12. An input jack 14 and an output jack 16 are formed upon the case, preferably the upper end 18 thereof. An indicator, preferably a rectangular LED 20, is formed upon the case proximate the input 14 and output 16 jacks. The input 14 and output 16 jacks preferably comprise standard mini-jacks such as those commonly used with items powered by contemporary AC to DC converters.

Figure 6:
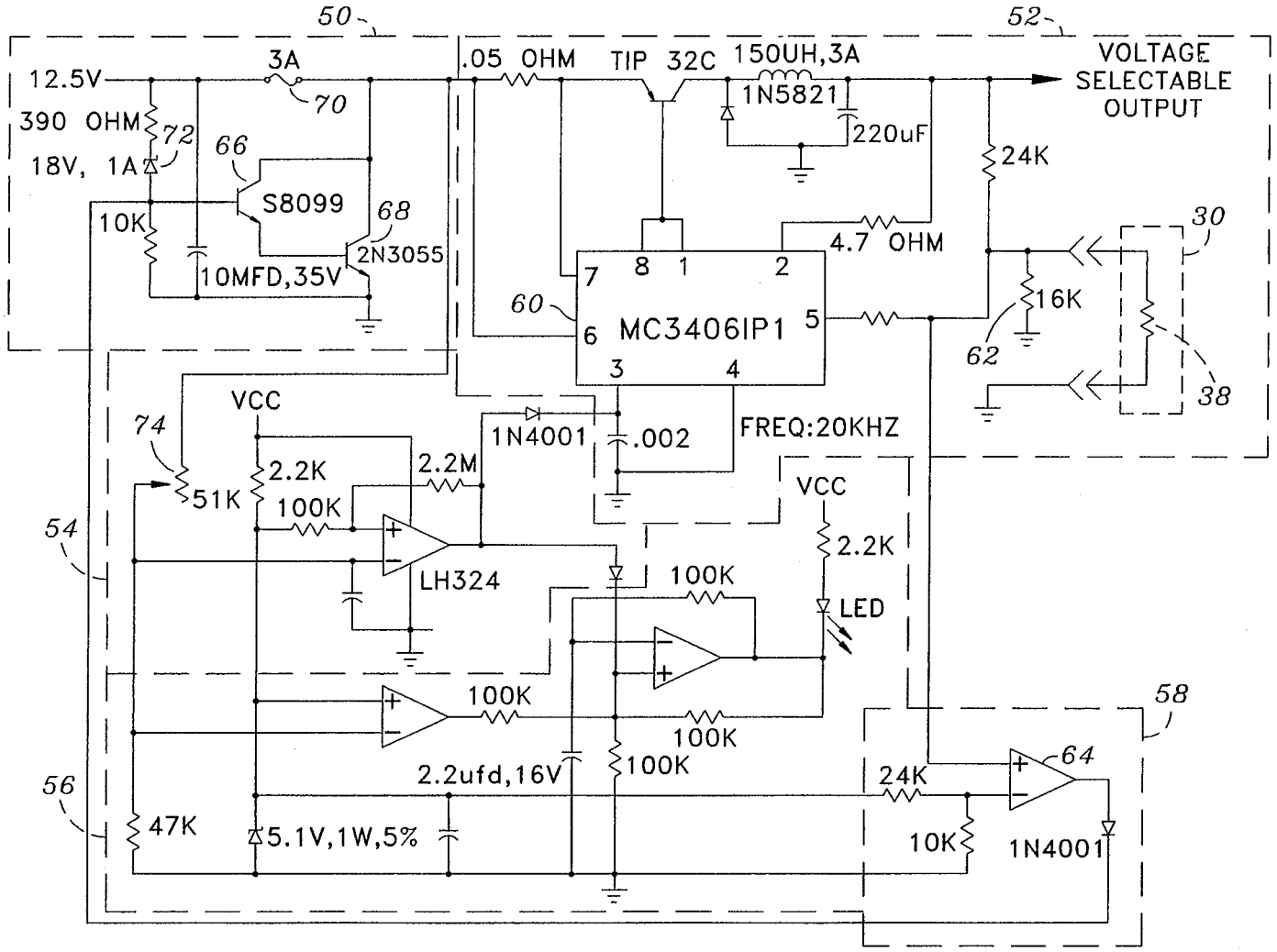
FIG. 6 is an electrical schematic of the converter means and key of the present invention.

Optionally, cooling fins 22 are formed upon the sides 24 of the case 10 to facilitate cooling of the converter circuit (as shown in FIG. 6) contained therein. Attachment means or track 26 formed upon the rear 28 of the converter 10 facilitates attachment thereof to a battery power pack such as Model 06-1101 manufactured by Innova Electronics, Inc. of Fountain Valley, Calif.

Figure 2:
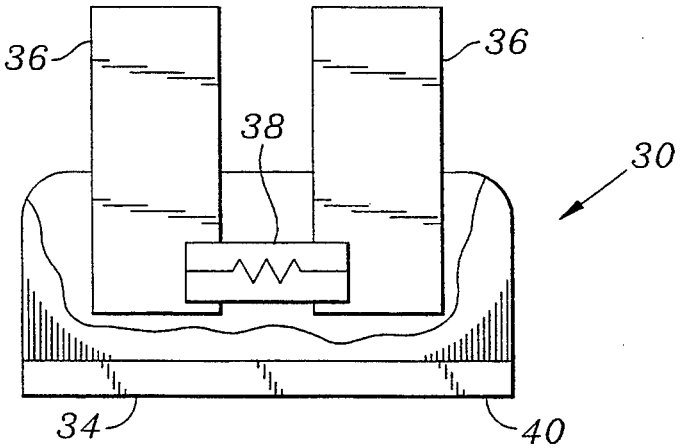
FIG. 2 is an enlarged front view of the key of FIG. 1.

A key 30 is removably insertable into a keyway 32 (as best seen in FIG. 4) of the converter 10. The key 30 contains an electrical component 38 (as shown in FIGS. 2 and 3), preferably a resistor, the value of which determines the output voltage of the converter 10.

The body 34 of the key 30 may optionally be the electrical component 38 itself, thus eliminating the need to fabricate a separate body. The key 30 is preferably configured in a manner like that of blade-type automobile fuses. The key 30 comprises a body 34 and two blades 36 which are received within the keyway 32.

The key 30 is preferably configured such that removal thereof from the keyway 32 results in an indication of removal being formed upon the key. The indication of removal may comprise marring, scratching, marking, or any other modification or alteration of the key which may serve as an indication that the key has been previously installed into a converter 10 and then removed therefrom.

Alternatively, the key may be configured such that removal thereof from the keyway results from breakage of the key 30 such that the key 30 becomes inoperative and a converter into which it is subsequently installed will not function or alternatively functions only on the lowest output voltage.

Marring, scratching, or marking of the key may be accomplished, for example, by providing a stylus 37 within the body 12 of the converter 10 such that a sharp tip 39 of the stylus abuts and scrapes, marks, or mars the body of the key 30 as the key 30 is inserted and removed from the keyway 32.

Breakage of the key 30 may be accomplished by provided a barb or detent means (not shown) within the body 12 of the converter 10 such that the barb or detent engages a portion of the key 30. The key 30 is configured to have a structural weakness such that removal of the key 30 from the converter 10 results in breakage thereof as the barb or detent maintains engagement thereof during the withdrawal process. That is, a portion of the key 30 is engaged by the barb or detent of the converter 10 and is only released upon breakage of the key 30.

Referring now to FIGS. 2 and 3, the electrical component 38 is electrically interconnected to the blades 36 such that a circuit is formed serially through the blades 36 and the electrical component 38. Indicia (not shown) are optionally formed upon the upper surface 40 of the body 34 indicative of the output voltage which results from insertion of the key 30 into the converter 10.

Although the electrical component 38 preferably comprises a resistor, those skilled in the art will recognize that various electrical components, i.e., capacitors, inductors, etc., are likewise suitable. It is only necessary that the electrical component have a readily identifiable value such that the electrical circuitry of the charger 36 can determine therefrom the desired output voltage.

Referring now to FIG. 4, a key 30 has been inserted into the keyway 32 of the converter 10. Thus, the converter 10 has been enabled to provide an output voltage as determined by the value of the electrical component 36 disposed within the body 34 of the key 30. The keyway 32 is attached to a printed circuit board 42 via legs 44. The electrical components of the converter circuit (as shown in FIG. 6) are generally disposed upon the printed circuit board 42. Electrical contacts 46 extend from the printed circuit board 42 and provide electrical interconnection to the battery power pack, if the battery pack is attached to the power converter 10 via the track 26.

Referring now to FIG. 6, a representative converter circuit is illustrated. Those skilled in the art will recognize that various other converter circuits are likewise suitable. Indeed, converter circuits are contemplated for DC-DC conversion, AC-DC conversion, DC-AC conversion, and AC-AC conversion.

The converter circuit preferably comprises feedback circuitry in which the electrical component 38 of the key 30 is utilized to set the output voltage thereof. The absence of any electrical component 38 within a key results in the output of the feedback circuitry being minimal, i.e., 1.5 volts. Indeed, the selectable output power converter of the present invention may optionally be operable at its lowest output voltage with no key installed therein.

More particularly, the selectable output power converter of the present invention generally comprises an input overvoltage protection circuit 50, a selectable voltage key circuit 52, a low battery voltage shut-off circuit 54, a low battery warning circuit 56, and an output overvoltage protection circuit 58.

The selectable voltage key circuit 52 comprises a user removable key 30 having an electrical component disposed therein, preferably a resistor 38, and is preferably configured similar to a blade-type car fuse. The resistor 38 of the key 30 replaces the fusing link of the blade-type car fuse. The resistor 38 is used in the feedback portion of the voltage regulator to select the output voltage. The advantage of this method is that the desired voltage can easily be selected any time.

Although it is contemplated that for some applications the voltage will be pre-selected by the manufacturer, ease of changing the key 30 facilitates easy voltage selection by the end user or consumer. That is, the output voltage of the selectable voltage power converter of the present invention is selected by utilizing the appropriate key 30. Selectable voltage pulse width modulator (PWM) regulator integrated circuit chip 60 provides a regulated output at the voltage determined by resistor 38.

For example, the resistor 38 may have values of 5.2K ohm, 4.7K ohm, or 3.9k ohm to provide output voltages of 6.0 volts DC, 7.5 volts DC, or 9.0 volts DC respectively. Resistor 62 is in parallel with the resistor 38 of the key 30 such that an output voltage of 3.3 volts DC will be provided if no key 30 is inserted. Alternatively, the converter circuit may be configured to provide any other desired output voltage, including zero output, when no key is installed.

Alternatively, the key 30 may contain one or more jumpers to define the desired output of the selectable power converter of the present invention.

The output overvoltage protection circuit 58 is provided so as to limit any damage caused to a device powered by the selectable power converter of the present invention due to a defective component, i.e., integrated circuit, of the power converter. The voltage at pin 5 of integrated circuit 60 will always have the steady-state nominal value of 1.25 volts DC when the power converter is functioning properly. Operational amplifier 64 monitors this reference voltage. When the reference voltage exceeds 1.25 volts DC by a selected amount, i.e., 20 percent, the voltage on the output of the operational amplifier 64 goes high. This causes transistor 66 and transistor 68 of the input voltage protection circuit 50 to conduct and thereby short out the input voltage to ground so as to cause internal non-replaceable fuse 70 to burn out.

The fuse 70 is preferably positioned within a housing within which the converter circuit is disposed so as to be non-replaceable. Alternatively, the fuse 70 may be accessible from outside the housing so as to be replaceable.

It is assumed that deviation of the 1.25 volts DC reference voltage is the result of a catastrophic failure of the selectable output power converter of the present invention and that the present invention can thus no longer function reliably. Please note that the reference voltage on pin 5 of integrated circuit 60 maintains its nominal value, i.e., 1.25 volts DC, regardless of the value of the output voltage selected.

Alteratively, the output voltage may be monitored by monitoring the voltage across a second voltage divider circuit. This would eliminate the potential for problems caused by shorting of pin 5 of integrated circuit 60.

Also, the overvoltage protection may alternatively be implemented by adding a second set of resistors which are not connected to pin 5 of integrated circuit 60, but rather configured such that when pin 5 becomes shorted to ground, the voltage on pin 12 is not pulled to ground and therefore appears to be less than 20 percent over the selected voltage.

Another optional method for providing overvoltage protection is to use a window comparitor, i.e., two operational amplifiers to insure that the voltage is maintained between ±20 percent of the selected voltage. A less desirable method of overvoltage protection may be provided by simply monitoring the output voltage and causing an internal fuse to blow if the output voltage exceeds the highest selectable voltage by approximately 0.5 volts.

The input overvoltage protection circuit 50 is utilized to limit any damage due to an excessive input voltage or due to input voltage spikes having long durations. If the DC input voltage exceeds 18 volts, then zener diode 72 conducts to turn on transistors 66 and 68, thereby shorting the input to ground and blowing fuse 70 as discussed above. Short duration spikes may cause zener diode 72 to conduct and transistors 66 and 68 to turn on without blowing fuse 70. The input voltage falls quickly as transistor 68 turns on, thereby causing zener diode 72 to cease conducting. However, longer duration spikes will result in fuse 70 blowing. The circuit clamps down voltage spikes up to 75 volts and 10 ms in duration.

The low battery warning circuit 56 is used to indicate to the user that the battery voltage has fallen below a predetermined limit, i.e., 11 volts DC. When the selectable power output converter of the present invention has power applied to it, the red LED 20 illuminates. When the input voltage falls below the predetermined value, i.e., 11 volts DC, the LED 20 begins blinking to indicate a low battery condition.

The low battery voltage shut-off circuit 54 turns off the output voltage when the input voltage falls below a predetermined value, i.e., 10.5 volts DC. This prevents damage to the battery, particularly sealed lead-acid batteries, from excessive discharging thereof. The LED 20 ceases blinking to indicate low battery. Trim pot 74 is used to compensate for variances in component values such that the low battery voltage shut-off triggers at the desired preset value.

Referring now to FIG. 7 and 8, the selectable output power converter 10 of the present invention may optionally be utilized in conjunction with a portable 12-volt DC rechargeable power source such as the POWERPAK 100, sold by Innova of Fountain Valley, Calif. The POWERPAK 100 device is described in detail in U.S. patent application Ser. No. 07/771,684 filed on Oct. 4, 1991 and entitled POWER SUPPLY UNIT, the contents of which are hereby incorporated by reference.

The POWERPAK 100 has formed upon it at least one track 102, to removably attach the selectable output power converter 10 of the present invention or other devices thereto. The selectable output power converter of the present invention 10 has a complimentary track 26 formed thereupon to facilitate mechanical attachment thereof to the POWERPAK 100. Electrical contacts 46 (as shown in FIG. 4) facilitate electrical interconnection to corresponding electrical contacts 104 formed upon the tracks 102 of the POWERPAK 100.

Thus, by attaching a selectable output power converter 10 of the present invention to the POWERPAK 100, the user is provided with a portable, regulated DC power source at the desired voltage such that a laptop computer or similar device may be electrically powered therefrom.

Alternatively, the POWERPAK 100 may comprise a plurality of tracks 102 to facilitate the attachment of more than one selectable output power converter thereto or to facilitate the attachment of various other electronically powered devices thereto.

Having thus described the structure of the selectable output power converter of the present invention, it may be beneficial to describe the operation thereof. A key 30 is selected having an electrical component 36 disposed within the body 34 thereof such that a desired output voltage is provided at the output jack 16 of the converter 10 when the key 30 is received within the keyway 32 thereof.

Input power is provided to the converter 10 via input jack 14. In the preferred embodiment of the present invention, the converter 10 receives between approximately 10.5 volts and 15 volts DC at the input jack 14 and provides various voltages between 3 and 24 volts DC at the output jack 16, depending upon which key is inserted. The input to the converter 10 is typically the battery voltage of a car, boat, etc. and is typically approximately 12 volts DC. The input connection to the power converter may be conveniently accomplished by providing a cable which connects a car's cigarette lighter to the input jack 14.

Separate embodiments of the selectable output power converter of the present invention may be fabricated to provide output within various ranges. For example, a first embodiment might provide output voltages in the range of 3 to 9.5 volts and a second embodiment might provide voltages in the range of 16 to 24 volts.

Power converter output voltages may be provided at 1.5, 3, 4.5, 6, 7.5, 9, and 12 volts DC. Thus, the input power supplied to the input jack 14 of the converter 10 typically is supplied by an automobile battery or the like having a nominal output of approximately 12.5 volts. As one alternative, the input power supplied to the input jack 16 may comprise 110 volts AC such as that provided by a common wall outlet. Those skilled in the art will recognize that the electronic circuitry of the converter 10 may easily be configured to receive various AC or DC input voltages and likewise to provide various AC or DC outputs, depending upon the value of an electrical component 38 disposed within the body 34 of the key 30.

Thus, to utilize the selectable output power converter of the present invention, suitable connections are made from the input jack 14 to a power source and from the output jack 16 to the device to powered thereby. Illumination of LED 20 indicates proper functioning of the selectable output power converter of the present invention. Flashing of the LED 20 indicates that a low voltage condition, i.e., typically indicative of a partially drained battery, has occurred. Non-illumination of the LED 20 indicates that the selectable output power converter of the present invention has shut down and that no output is being provided. This typically indicates that the battery output to which the selectable output power converter is connected has fallen below a predetermined level. The selectable output power converter shuts down to prevent complete draining Of the battery and consequent potential damage thereto. Non-illumination of the LED 20 may also indicate that an overvoltage condition has caused the power conditioner to shut down.

The converter 10 may optionally be attached to a battery power pack via track 26 such that electrical connectors 46 thereof receive electrical power from the battery power pack. Thus, a convenient portable power source of a desired voltage is provided thereby.

It is understood that the exemplary selectable output power converter of the present invention described herein and shown in the drawings represents only the preferred embodiment of the invention. Indeed, various modifications and additions may be made to such embodiment without departing from the spirit and scope of the invention. For example, the precise mechanical configuration of the key may vary considerably. It is only necessary that the key be attachable to and removable from the converter 10 in a manner which facilitates recognition of the value of the electrical component 38 by the electrical circuitry of the converter. Also, various sizes, shapes, and configurations of the body 12 of the converter are contemplated. Also, various configurations of the interconnection of the converter with the input power source and the output device are likewise contemplated. Thus, these and other modifications and additions may be obvious to those skilled in the art and may be implemented to adapt the present invention for use in a variety of different applications.

What is claimed is:

1. A power converter for providing a selectable output voltage, the power converter comprising:

(a) a converter circuit having an input port for receiving an input voltage and an output port for providing an output voltage, said converter circuit having a keyway;

(b) a key configured to be received by said keyway, said key comprising a body within which an electrical component is disposed, said electrical component having a predetermined value; and (c) wherein the value of the output voltage is determined by the value of said electrical component such that the output voltage is varied by replacing the key with another key having an electronic component of a different value.

2. The power converter as recited in claim 1 wherein said key body is configured as a blade-type automobile fuse.

3. The power converter as recited in claim 1 wherein said electrical component is selected from the list consisting of:

(a) a resistor;

(b) a capacitor; and (c) an inductor.

4. The power converter as recited in claim 1 wherein said input voltage is a DC voltage.

5. The power converter as recited in claim 1 wherein said output voltage is a DC voltage.

6. The power converter as recited in claim 1 wherein the value of the output voltage is a predetermined value when no key is received by said keyway.

7. The power converter as recited in claim 1 wherein the value of the output voltage is at its minimum operating value when no key is received by said keyway.

8. The power converter as recited in claim 1 wherein the value of the output voltage is zero volts when no key is received by said keyway.

9. The power converter as recited in claim 1 wherein said key is configured such that removal thereof from said keyway results in an indication of removal being formed upon said key.

10. The power converter as recited in claim 1 wherein said key is configured such that removal thereof from said keyway results in breakage of said key.

11. The power converter as recited in claim 1 wherein said key is configured such that removal thereof from said keyway results in marring of said key.

12. The power converter as recited in claim 1 further comprising a body within which said converter circuitry is disposed, said body being electronically and mechanically configured to be attached to a battery pack and to receive power therefrom.

13. The power converter as recited in claim 12 wherein said converter circuit is disposed within a housing and said fuse is accessible from outside said housing so as to be replaceable.

14. The power converter as recited in claim 12 wherein said converter circuit is disposed within a housing and said fuse is also disposed within said housing so as to be non-replaceable.

15. The power converter as recited in claim 1 wherein said converter circuit further comprises a fuse in series with said input port for protecting said converter circuit from an excessive input voltage.

16. The power converter as recited in claim 1 wherein the converter circuit further comprises:

(a) an integrated circuit chip providing a reference voltage indicative of the value of the output voltage of the converter circuit;

(b) means for monitoring the reference voltage;

(c) switch means for causing said fuse to conduct more current than it is rated for and thereby to blow;

(d) wherein said monitoring means causes conduction of said switch means when the reference voltage indicates an excessive output voltage, thereby causing said fuse to blow.

17. The power converter as recited in claim 1 further comprising an input voltage monitoring circuit, said input voltage monitoring circuit providing an indication of low input voltage.

18. A power converter as recited in claim 17 wherein said input voltage monitoring circuit disables said converter circuit upon an indication that the input voltage has dropped below a predetermined value.

19. The power converter as recited in claim 1 further comprising a portable power supply to which said converter circuit is removably attachable.

20. The power converter as recited in claim 19 wherein:

(a) said converter circuit is disposed within a first body having first tracks and first electrical contacts formed thereon; and (b) said portable power supply is disposed within a second body having complimentary second tracks and second electrical contacts formed thereon;

(c) wherein said first and second tracks engage to removably attach said first body to said second body and said first and second contacts abut to provide electrical interconnection of said converter circuit and said portable power supply.

21. The power converter as recited in claim 1 wherein said converter circuit further comprises a voltage regulator circuit.

* * * * *